United States Patent [19]

Ireland

[11] Patent Number: 4,460,238

[45] Date of Patent: Jul. 17, 1984

[54] ELECTRICAL COUPLING

[75] Inventor: Hugh C. Ireland, Coylton, Scotland

[73] Assignee: Simplex-GE (Holdings) Limited, Stoke-on-Trent, England

[21] Appl. No.: 370,753

[22] Filed: Apr. 21, 1982

[51] Int. Cl.[3] ..... H01R 13/15

[52] U.S. Cl. ..... 339/255 R; 339/205

[58] Field of Search ..... 339/49 R, 49 B, 255 R, 339/204, 205, 176 M, 111

[56] References Cited

U.S. PATENT DOCUMENTS

| | | | |
|---|---|---|---|
| 3,235,682 | 2/1966 | Papworth | 339/111 X |
| 3,330,920 | 7/1967 | Appleton | 339/111 X |
| 3,860,321 | 1/1975 | Ball | 339/111 |
| 4,229,061 | 10/1980 | Majors | 339/49 B X |

FOREIGN PATENT DOCUMENTS

| | | | |
|---|---|---|---|
| 60081 | 2/1968 | German Democratic Rep. | 339/205 |
| 2013422 | 8/1979 | United Kingdom | 339/205 |
| 610215 | 5/1978 | U.S.S.R. | 339/205 |

*Primary Examiner*—Z. R. Bilinsky

*Attorney, Agent, or Firm*—Mason, Fenwick & Lawrence

[57] ABSTRACT

The invention provides for electrical coupling pins 5 for interconnecting two opposed electrical cable terminals having sockets 3, at least one of said sockets having a male contact member with a tapered end portion.

The coupling pins each include a hollow tubular member 21 and two electrically interconnected contact members mounted for relative movement therebetween along a longitudinal axis of the member 21 and resiliently biased away from each other.

At least one of the contact members 24 comprises a pair of segmental members 27, 27a resiliently biased away from each other transversely of the longitudinal axis of the member 21 and counterbored in the direction of said longitudinal axis to provide radially inner contact surfaces for closely contacting the tapered end portion of the male contact member when in use. According to a further aspect, the invention also provides for an electrical coupling including a pair of opposed cable terminals 2 each having at least one socket 3 therein, said coupling pin 5 according to the above first aspect being insertable in the socket or each socket to connect the cable terminals together. Each socket 3 is provided with a male contact member 19 engageable in the counterbore of the contact member 24 to effect a wedging action on the segmental members and to provide positive electrical contact between the male contact member and the counterbore surface and between the segmental contact members and the tubular member.

4 Claims, 5 Drawing Figures

ELECTRICAL COUPLING

This invention relates to an electrical coupling which has a particular application in the coupling of cable terminals in mines and other locations where a high degree of care is required to minimize the risk of fire and explosion.

According to a first aspect of the invention there is provided an electrical coupling pin for interconnecting two electrical cable terminal sockets, at least one of said sockets having a male contact member with a tapered end portion, said coupling pin including a hollow generally tubular electrically conductive member and two contact members of electrically conductive material electrically interconnected in use through said tubular member and mounted for relative movement therebetween along a longitudinal axis of the tubular member and resiliently biased away from each other, at least one of said contact members comprising at least two segmental members each having a radially outer surface for contacting a radially inner contact surface of the tubular member and having at least one radially inner contact surface in the form of a respective segment of a conical or frusto conical surface formed for substantially closely contacting, in use, a said male contact member tapered end portion, said segmental members being formed and arranged so that in use of the coupling pin, said male contact member tapered end portion engages said segmental member inner radial contact surfaces with a force fit clamping the segmental members radially outer contact surfaces against the radially inner contact surface of the tubular member thereby providing positive electrical contact between said male contact member and said segmental contact members and between said segmental members and said tubular member.

According to another aspect of the invention there is provided an electrical coupling including a pair of opposed cable terminals each having at least one socket therein, said sockets having mutually facing open ends and a male contact member with a tapered end portion located in each socket and a coupling pin according to said first aspect removably insertable in the sockets via said mutually facing open ends to interconnect the sockets, said tapered end portion of the male contact member being formed complemental to the radially inner contact surface of said contact member of the coupling pin to provide positive electrical contact between said male contact member and said segmental contact members and between said segmental members and said tubular member.

The electrical coupling of the present invention provides an improved positive mechanical locking of the contact members in the coupling pin with the tapered end portion of the male contact member of the socket as the contact member in the coupling pin and the male contact member are in wedged engagement with each other and the contact member is wedged into contact with the tubular member, the complemental surfaces of the male contact member and the radially inner surfaces of the segmental contact members also provide a desirable self-cleaning feature when the members are moved axially into or out of contact with one another.

Embodiments of the invention will now be described, by way of example, with reference to the accompanying drawings in which.

Figure 1:
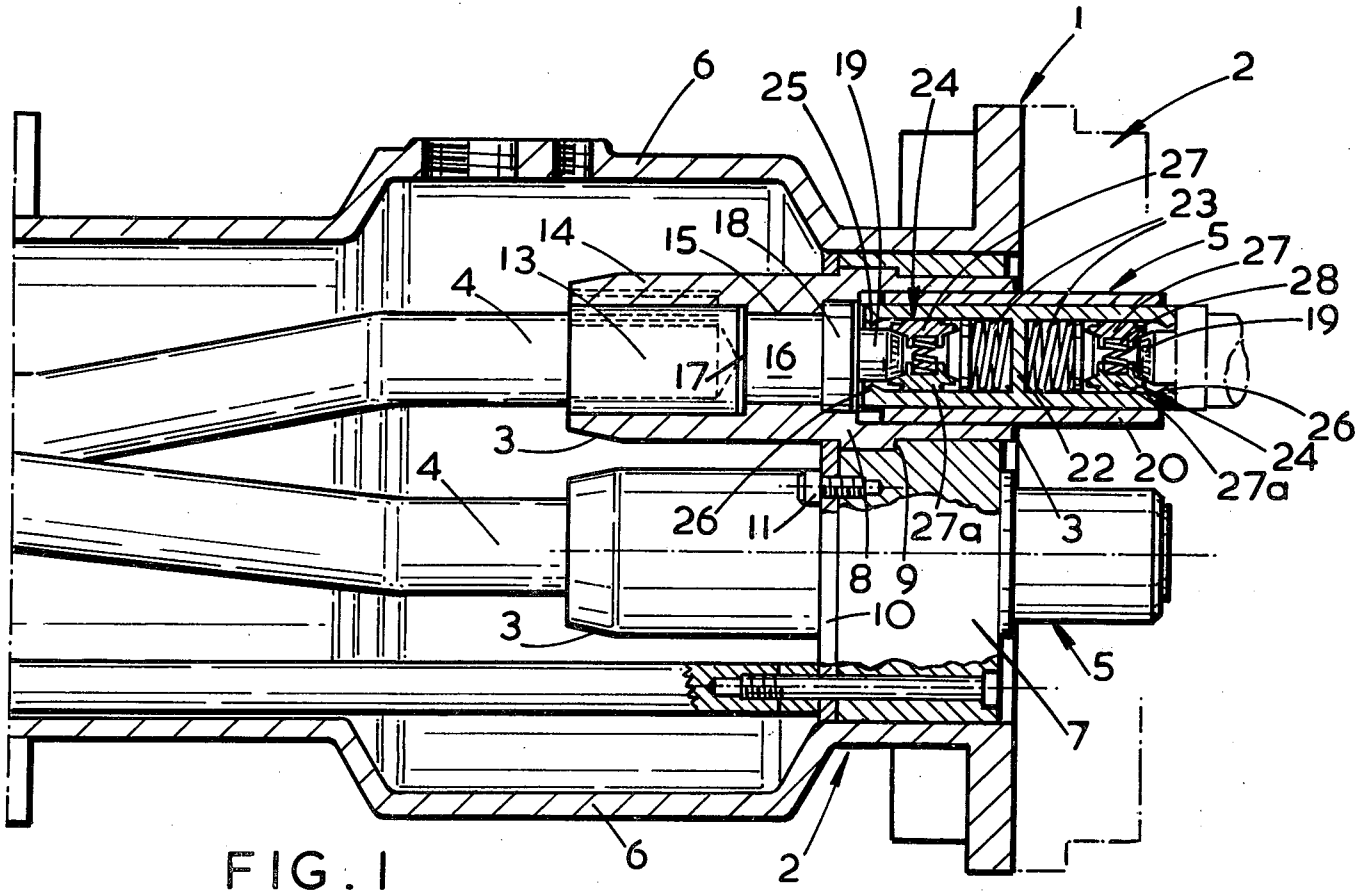
FIG. 1 is a sectional view of an electrical coupling incorporating cable terminals and a coupling pin according to a first embodiment of the invention.
Figure 2:
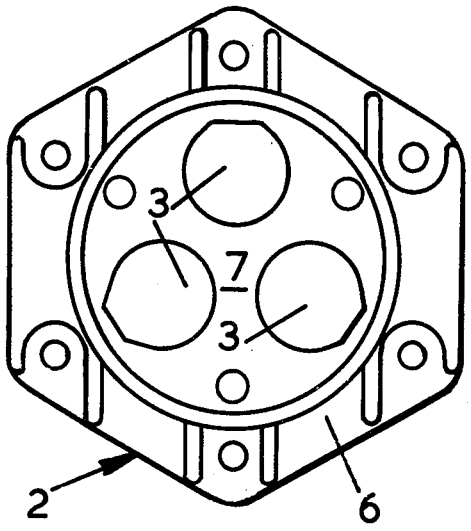
FIG. 2 is an end view of the cable terminal of FIG. 1.

Referring to FIGS. 1 to 4 of the drawings, an electrical coupling denoted generally at 1 comprises a pair of opposed cable terminals denoted generally at 2 (only one of which is shown in full lines, the outline of part of the other is shown in chain lines). Each of the cable terminals, as can be best seen in FIG. 2, has three sockets within each of which a socket member 3 is located and to each socket member a cable lead 4 is connected. The cable terminals may have more or less than three sockets depending on the number of cable leads to be connected. Respective coupling pins 5 are removably insertable in the socket members 3 to interconnect pairs of opposed socket members.

Each cable terminal 2 comprises a brass housing 6 mounted on the end of a cable having cable leads 4. A carrier block 7 of insulating material is secured in a recessed end of the housing 6 and has through bores which carry the socket member 3. The socket members 3 comprise a hollow tubular moulded casing of insulating material having an external annular rib 8 which engages a shoulder 9 formed in the bore and the socket member 3 is held in the bore in the block by means of a retaining plate 10 secured to the block by bolts 11.

An electrical cable lead 4 is inserted into the rear open end of each socket member 3 and is secured therein by means of a screw member mounted in the insulated casing of the socket member to make contact with the core 13 of the cable lead. The hollow casing of the socket member is provided with an internal annular rib 15 which is engaged by a contact member 16 having a retaining flange 17 at one end a ring nut 18 at the other end and between which the rib 15 is held. The contact member 16 has a cylindrical male protrusion 19 which extends towards the open front end of the socket member 3 and is clear of the internal surface of the socket member casing. The male protrusion 19 has a tapered end portion, which may be knurled, to provide a wedging contact with contact members in the coupling pin 5.

Figure 3:
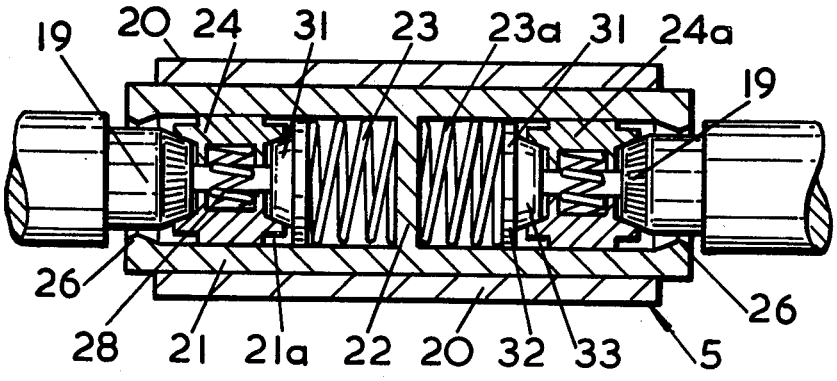
FIG. 3 is an enlarged view of the coupling pin of FIG. 1.

As will be seen from FIG. 3 each coupling pin 5 has an outer moulded electrically insulated tubular sleeve 20 and an inner tubular copper member 21 co-axial with the sleeve 20 and open at each end.

The tubular member 21 has a central transverse partition 22 which acts as an end stopper for compression springs 23 and **23*a* located on each side of the partition 22 and which bias respective axially movable contacts 24 and 24*a* towards the open end of the tubular member 21**.

Annular inwardly projecting lips 26 at each end of the tubular member 21 serve to retain the contacts 24 within the tubular member 21.

Figure 4:
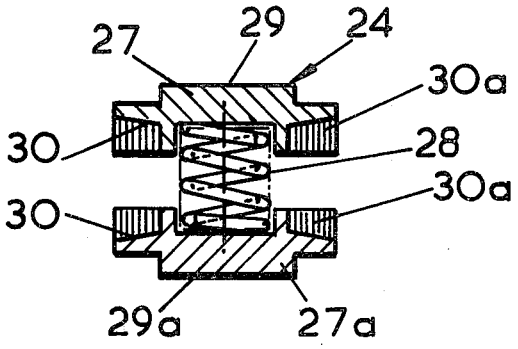
FIG. 4 is an enlarged view of contact members embodied in the coupling pin of FIG. 3.

Each contact **24, 24*a* as best seen in FIG. 4, comprises a pair of segmental members 27 biased apart by a spring 28 acting transversely of the longitudinal axis of the tubular member 21. The segmental members 27 and 27*a* have radially outer contact surfaces 29, 29*a* for contacting the radially inner surface 21*a*** of the tubular member 21 and are counterbored axially of the tubular member to form radially inner contact surfaces 30, 30*a* in the form of a segment of a conical or frusto conical surface to form a mating surface for the tapered end portion 19 of the male protrusion contact in the socket member 3. The surface 30 may be provided with annular grooves or serations to provide good electrical contact with the tapered end portion 19 of the male contact member. The tapered end portion 19 of the male contact member when brought into contact with the surfaces 30 form a wedging effect to clamp the radially outer contact surfaces 29 and 29*a* against the inner surface of the tubular member and to provide positive electrical contact betwen the male contact member and the segmental contact members 27 and 27*a*. The counterbore 30*a* provides contact surfaces for a spring retainer 31 located at the end of the springs 23, 23*a* adjacent the contacts 24, 24*a*.

The spring retainers have a flanged portion 32 from which extends a frusto conical or tapered portion 33 which mates with the counterbore 30 of the contact 24 and 24*a*.

In operation, to interconnect electrically two opposed cable terminals 2, it is merely necessary to insert a coupling pin 5 into each socket of one of the cable terminals and to use that cable terminal as a plug which can be plugged into the other juxtaposed cable terminal.

The male protrusion 19 in each socket member enter its respective tubular member 21 and makes electrical contact with its respective contact 24 or 24*a*. When the tapered end portion of the male protrusion 19 enters the counterbore 30 of the contact 24 or 24*a* the segmental members 27 are forced apart by a wedging action to make positive contact with the inner surface of the tubular member 21 and to hold the protrusion in positive contact with the contact surface 30, 30*a*.

Figure 5:
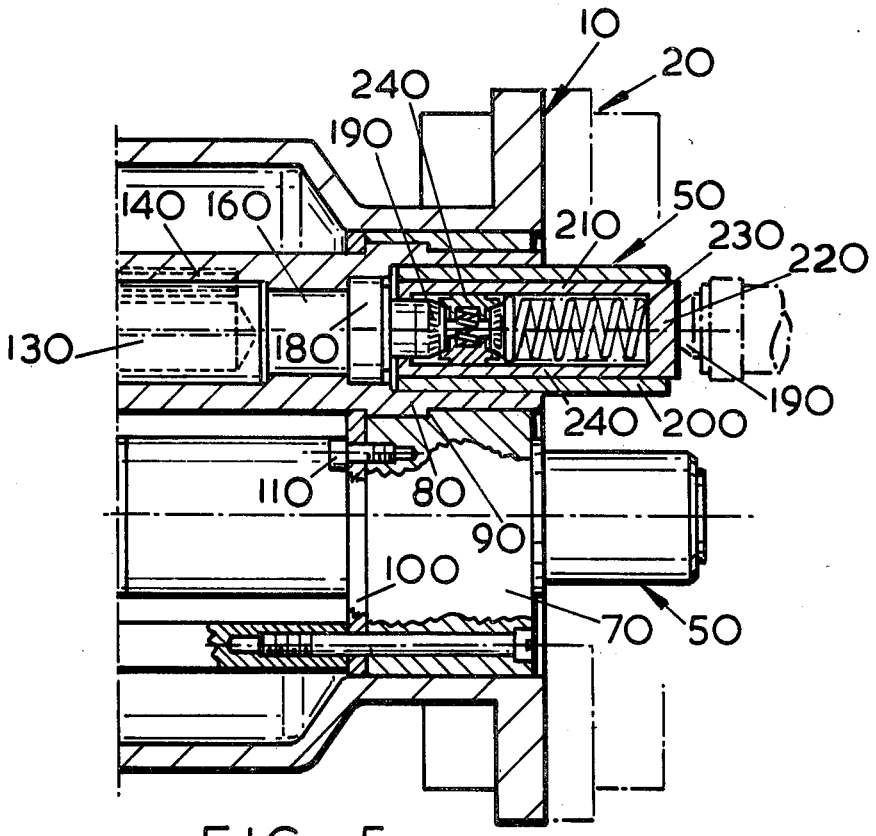
FIG. 5 is a view corresponding to part of the view of FIG. 1 showing an alternative embodiment of the coupling pin.

An alternative form of coupling pin is shown in FIG. 5 in which like members to that of FIGS. 1 to 4 are denoted by the addition of the number 0 to the reference number.

The alternative form of coupling pin differs from that shown in FIGS. 1 and 3 in that only one movable contact denoted as 240 is provided in each coupling pin.

The tubular member 210 has one end blanked off by means of an end portion 220.

Thus in this embodiment the coupling pin 50 is constituted by half of the coupling pin 5 and the contact 240 is movable longitudinally of the tubular member 210 while the other contact is formed by the fixed end portion 220.

In operation coupling pins 50 may be inserted in their respective socket members in alternate directions.

What is claimed is:

1. An electrical coupling pin for interconnecting two electrical cable terminal sockets, at least one of said sockets having a male contact member with a tapered end portion, said coupling pin including a hollow, generally tubular, electrically conductive member having a radially inner contact surface and a longitudinal axis; two contact members of electrically conductive material mounted for relative movement there between along the longitudinal axis of said tubular member, at least one of said contact members comprising at least two segmental members each having a radially outer contact surface for contacting the the radially inner contact surface of said tubular member and having at least one radially inner contact surface in the form of a respective segment of a conical or frusto conical surface formed for substantially closely contacting, in use, a said male contact member tapered end portion, said segmental members being formed and arranged so that in use of said coupling pin, said male contact member tapered end portion engages said segmental member radially inner contact surfaces with a force fit clamping the segmental members radially outer contact surfaces against the radially inner contact surface of the tubular member, thereby providing positive electrical contact between said male contact member and said segmental contact members and between said segmental members and said tubular members; means for electrically interconnecting said two contact members in use through said tubular member; and means mounted in said tubular member for resiliently biasing said two contact members away from each other.

2. An electrical coupling pin as claimed in claim 1 wherein said one of said contact members comprises a pair of opposed, segmental members resiliently biased away from each other transversely of the axis of the tubular member and the frusto conical surfaces of the segmental members are co-axial with the tubular member.

3. An electrical couping pin as claimed in claim 1 in which the radially inner contact surfaces of the segmental members are provided with annular grooves.

4. An electrical coupling including:

a pair of opposed cable terminals each having at least one socket therein, each said at least one socket having mutually facing open ends;

a male contact member with a tapered end portion located in each said at least one socket;

and a coupling pin removably insertable in each said at least one socket via said mutually facing open ends to interconnect each said at least one socket, said coupling pin including:

a hollow, generally tubular, electrically conductive member having a radially inner contact surface and a longitudinal axis;

two contact members of electrically conductive material mounted for relative movement there between along the longitudinal axis of said tubular member, at least one of said contact members comprising at least two segmental members each having a radially outer contact surface for contacting the radially inner contact surface of said tubular member and having at least one radially inner contact surface in the form of a respective segment of a conical or frusto conical surface form for substantially closely contacting, in use, a male contact member tapered end portion, said segmental members being formed and arranged so that in use of said coupling pin, said male contact member tapered end portion engages said segmental member radially inner contact surfaces with a force fed clamping the segmental members radially outer contact surfaces against the radially inner contact surface of the tubular member, thereby providing positive electrical contact between said male contact member and said segmental contact members and between said segmental members and said tubular member;

means for electrically interconnecting said two contact members in use through said tubular member; and means mounted in said tubular member for resiliently biasing said two contact members away from each other;

said tapered end portion of said male contact member being formed complimental to the radially inner contact surface of said contact member of said coupling pin to provide positive electrical contact between said male contact member and said segmental contact members and between said segmental members and said tubular member.

* * * * *